US011239557B2

(12) United States Patent
Wu et al.

(10) Patent No.: US 11,239,557 B2
(45) Date of Patent: Feb. 1, 2022

(54) ANTENNA STRUCTURE AND COMMUNICATION DEVICE

(71) Applicant: PEGATRON CORPORATION, Taipei (TW)

(72) Inventors: Chien-Yi Wu, Taipei (TW); Cheng-Hsiung Wu, Taipei (TW); Chao-Hsu Wu, Taipei (TW); Ching-Hsiang Ko, Taipei (TW); Tse-Hsuan Wang, Taipei (TW); Shih-Keng Huang, Taipei (TW); Yi-Ru Yang, Taipei (TW); Sheng-Chin Hsu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 33 days.

(21) Appl. No.: 17/006,546

(22) Filed: Aug. 28, 2020

(65) Prior Publication Data

US 2021/0091466 A1 Mar. 25, 2021

(30) Foreign Application Priority Data

Sep. 24, 2019 (TW) ..... 108134438

(51) Int. Cl.
*H01Q 5/307* (2015.01)
*H01Q 1/48* (2006.01)
*H01Q 5/10* (2015.01)

(52) U.S. Cl.
CPC ..... *H01Q 5/307* (2015.01); *H01Q 1/48* (2013.01); *H01Q 5/10* (2015.01)

(58) Field of Classification Search
CPC ..... H01Q 5/307; H01Q 5/378
See application file for complete search history.

(56) References Cited

U.S. PATENT DOCUMENTS

| | | | | |
|---|---|---|---|---|
| 10,205,221 | B2 * | 2/2019 | Fan | H01Q 5/371 |
| 2012/0001815 | A1 | 1/2012 | Wong et al. | |
| 2021/0159611 | A1 * | 5/2021 | Wu | H01Q 9/42 |

FOREIGN PATENT DOCUMENTS

| | | |
|---|---|---|
| TW | I495196 | 8/2015 |
| TW | M568509 | 10/2018 |

* cited by examiner

*Primary Examiner* — Daniel Munoz
(74) *Attorney, Agent, or Firm* — J.C. Patents

(57) ABSTRACT

An antenna structure including a first radiator and a second radiator is provided. The first radiator includes a first section, a second section, and a third section. The first section has a feed-in end. The second section is adjacent to the first section and connected to a position of the first section close to the feed-in end. The third section is connected to the second section and the feed-in end to encircle a space. The second radiator is disposed around the first section and the second section. The second radiator includes a first end and a second end opposite to each other. The first end is a ground end. A coupling interval is formed between the second end and the third section. A first frequency band, a second frequency band, and a third frequency band are resonated by the first radiator and the second radiator.

20 Claims, 8 Drawing Sheets

ANTENNA STRUCTURE AND COMMUNICATION DEVICE

CROSS-REFERENCE TO RELATED APPLICATION

This application claims the priority benefit of Taiwan application serial no. 108134438, filed on Sep. 24, 2019. The entirety of the above-mentioned patent application is hereby incorporated by reference herein and made a part of this specification.

BACKGROUND

Technical Field

The application relates to an antenna structure and a communication device, and particularly relates to an antenna structure capable of resonating multiple frequency bands and a communication device.

Description of Related Art

Sub 6 GHz is one of a mainstream frequency band for 5G communication. In addition to a frequency band of 1710 MHz to 2700 MHz, a frequency band of 3300 MHz to 5000 MHz and a frequency band of 5150 MHz to 5850 MHz are also added. How to design an antenna structure that may resonate the above multiple frequency bands is a current research target in design of antennas.

SUMMARY

The application is directed to an antenna structure, which is capable of resonating signals of a plurality of frequency bands.

The application is directed to a communication device, which has the aforementioned antenna structure.

The application provides an antenna structure including a first radiator and a second radiator. The first radiator includes a first section, a second section and a third section, wherein the first section includes a feed-in end, the second section is adjacent to the first section and is connected to a position of the first section close to the feed-in end, and the third section is connected to the second section and the feed-in end to encircle a space. The second radiator is disposed around the first section and the second section, and the second radiator includes a first end and a second end opposite to each other, wherein the first end is a ground end, and a coupling interval is formed between the second end and the third section. A first frequency band, a second frequency band and a third frequency band are resonated by the first radiator and the second radiator.

In an embodiment of the application, the antenna structure further includes a first frequency modulation radiator and a second frequency modulation radiator. The first frequency modulation radiator is located in the space and is connected to the feed-in end. The second frequency modulation radiator is located in the space and is connected to the feed-in end, and the second frequency modulation radiator surrounds the first frequency modulation radiator.

In an embodiment of the application, an interval between the first frequency modulation radiator and the second frequency modulation radiator is between 0.3 mm and 0.5 mm.

In an embodiment of the application, the third section has a first region, a second region and a third region connected in a bending manner, the first region is connected to the second section, the third region is connected to the feed-in end, and a slot is formed in the third region.

In an embodiment of the application, the antenna structure further includes an antenna ground plane, wherein the second radiator includes a fourth section, a fifth section and a sixth section, the fifth section is respectively connected to the fourth section and the sixth section, the first end is located at the fourth section, the second end is located at the sixth section, and the fourth section is connected to the antenna ground plane.

In an embodiment of the application, the coupling interval is between 0.5 mm and 1 mm.

In an embodiment of the application, a length of the antenna structure is between 36 mm and 42 mm, and a width thereof is between 8 mm and 10 mm.

In an embodiment of the application, the first frequency band is between 1710 MHz and 2700 MHz, the second frequency band is between 3300 MHz and 5000 MHz, and the third frequency band is between 5150 MHz and 5850 MHz.

The application provides a communication device including an antenna structure, an antenna-plexer, a first chip and a second chip. The antenna-plexer is connected to the antenna structure, and includes a first filter unit, a second filter unit, a third filter unit, a fourth filter unit, a fifth filter unit and a switch unit, the switch unit is connected to the fifth filter unit. The first chip is connected to the first filter unit, the second filter unit, the third filter unit and the switch unit. The second chip is connected to the fourth filter unit and the switch unit, and the switch unit is switchably connected to the first chip or the second chip.

The application provides a communication device including two antenna structures and an isolation element, the two antenna structures are spaced by a first distance. The isolation element is disposed between the two antenna structures, and is spaced from each of the antenna structures by a second distance.

In an embodiment of the application, the first distance is between 60 mm and 70 mm, and the second distance is between 8 mm and 12 mm.

In an embodiment of the application, the isolation element is a conductor with a length between 40 mm and 50 mm.

Based on the above description, the antenna structure of the application is capable of resonating the first frequency band, the second frequency band and the third frequency band based on a design of the first radiator and the second radiator, so as to meet a requirement of multiple frequency bands. In an embodiment, two antenna structures are spaced by the first distance, and the isolation unit is arranged between the two antenna structures, so that the two antenna structures have good isolation. In one embodiment, the antenna structure of the communication device is switchably connected to the first chip or the second chip through the switch unit of the antenna-plexer, which uses a single antenna to achieve an effect of multiple antennas, and achieves a target of sharing a antenna space and reducing a usage amount of antenna.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DESCRIPTION OF THE EMBODIMENTS

Figure 1:
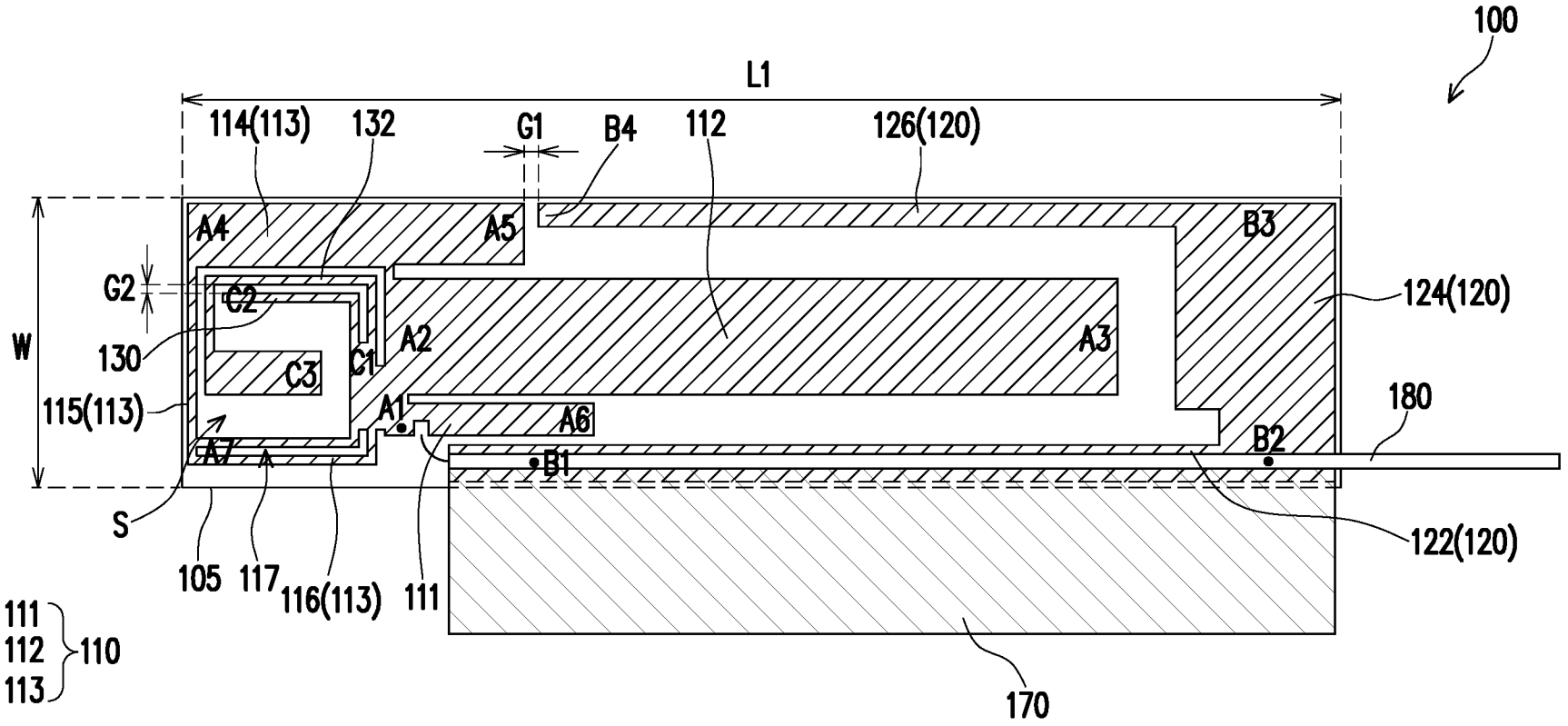
FIG. 1 is a schematic diagram of an antenna structure according to an embodiment of the application.

FIG. 1 is a schematic diagram of an antenna structure according to an embodiment of the application. Referring to FIG. 1, the antenna structure 100 of the embodiment may be disposed on a substrate 105. The substrate 105 is, for example, a rigid substrate or a flexible substrate, but the type of the substrate 105 is not limited thereto. In other embodiments, the substrate 105 may also be omitted.

As shown in FIG. 1, the antenna structure 100 includes a first radiator 110 and a second radiator 120. The first radiator 110 includes a first section 111 (a section from a position A1 to a position A6), a second section 112 (a section from a position A2 to a position A3) and a third section 113 (a section from positions A5, A5, A7 to the position A1).

In the embodiment, the first section 111 includes a feed-in end, which is at the position A1. The second section 112 is adjacent to the first section 111 and is connected to a position of the first section 111 close to the feed-in end. To be specific, the position A2 of the second section 112 is connected to the position A1 of the first section 111.

The third section 113 is connected to the second section 112 and the feed-in end (at the position A1) to encircle a space S. To be specific, in the embodiment, the third section 113 has a first region 114 (a section from the position A5 to the position A4), a second region 115 (a section from the position A4 to the position A7) and a third region 116 (a section from the position A7 to the position A1) connected in a bending manner. A portion of the first region 114 between the position A5 and the position A4 is connected to the position A2 of the second section 112, and the third region 116 is connected to the feed-in end (at the position A1).

According to FIG. 1, it is known that the first radiator 110 encircles the space S at the positions A1, A2, A4 and A7. In the embodiment, a slot 117 is formed in the third region 116 (the section from the position A7 to the position A1) of the third section 113, but in other embodiments, the third region 116 of the third section 113 may not have the internal slot 117.

In the embodiment, the second radiator 120 is disposed around the first section 111 and the second section 112 in a C-shape. The second radiator 120 includes a first end (at a position B1) and a second end (at a position B4) opposite to each other. The first end (at the position B1) is a ground end. The second radiator 120 includes a fourth section 122 (a section from the position B1 to a position B2), a fifth section 124 (a section from the position B2 to a position B3) and a sixth section 126 (a section from the position B3 to the position B4). The fifth section 124 is respectively connected to the fourth section 122 and the sixth section 126, the first end is located at the fourth section 122, and the second end is located at the sixth section 126.

Moreover, the antenna structure 100 further includes an antenna ground plane 170, and the fourth section 122 (the section from the position B1 to the position B2) is connected to the antenna ground plane 170 to conduct with a system ground plane (not shown). The antenna ground plane 170 is, for example, a copper foil or an aluminium foil, but the application is not limited thereto.

A signal positive end of a coaxial transmission line 180 is connected to the feed-in end (at the position A1), and a signal negative end of the coaxial transmission line 180 is grounded through the positions B1 and B2. In the embodiment, the coaxial transmission line 180 is made of a low-loss wire with a diameter of 1.13 mm and a wire length of 400 mm, but the type of the coaxial transmission line 180 is not limited thereto.

A coupling interval G1 is formed between the second end of the second radiator 120 and the third section 113 of the first radiator 110. To be specific, the coupling interval G1 is formed between the position B4 and the position A5. In the embodiment, the coupling interval G1 is between 0.5 mm and 1 mm, but the application is not limited thereto.

The first radiator 110 and the second radiator 120 of the antenna structure 100 of the embodiment forms an open-loop antenna structure through the coupling interval G1 to resonate a first frequency band, a second frequency band and a third frequency band. In the embodiment, the first frequency band is between 1710 MHz and 2700 MHz, the second frequency band is between 3300 MHz and 5000 MHz, and the third frequency band is between 5150 MHz and 5850 MHz. Certainly, the ranges of the first frequency band, the second frequency band and the third frequency band are not limited thereto.

To be specific, the first frequency band (from 1710 MHz to 2700 MHz) is formed by a path of the first radiator 110 at the positions A1, A7, A4, A2 to A3 and a path of the second radiator 120 at the positions B1, B2, B3 to B4 to generate a first open-loop resonance. Moreover, a designer may control a position of a frequency point of the first frequency band (from 1710 MHz to 2700 MHz) by adjusting a path length from the position A2 to the position A3.

The second frequency band (from 3300 MHz to 5000 MHz) is formed by a path of the first radiator 110 at the positions A1, A7, A4, A5 to A2 and the path of the second radiator 120 at the positions B1, B2, B3 to B4 to generate a second open-loop resonance. Moreover, the designer may control a position of a frequency point of the second frequency band (from 3300 MHz to 5000 MHz) by adjusting a path length from the position A4 to the position A5.

The third frequency band (from 5150 MHz to 5850 MHz) is formed by a path of the first radiator 110 at the positions A1, A7, A4, A5 A2, A1 to A6 and the path of the second radiator 120 at the positions B1, B2, B3 to B4 to generate a third open-loop resonance. Moreover, the designer may control a position of a frequency point of the third frequency band (from 5150 MHz to 5850 MHz) by adjusting a path length from the position A1 to the position A6.

Moreover, the antenna structure 100 further includes a first frequency modulation (FM) radiator 130 and a second FM radiator 132. The first FM radiator 130 and the second FM radiator 132 are located in the space S and are connected to the feed-in end (at the position A1), and the second FM radiator 132 surrounds the first FM radiator 131. The first FM radiator 130 is disposed adjacent to the second FM radiator 132 at equal intervals. An interval G2 between the first FM radiator 130 and the second FM radiator 132 is between 0.3 mm and 0.5 mm, but the application is not limited thereto.

In the embodiment, the first FM radiator 130 (from a position C1 to a position C2) and the second FM radiator 132 (from the position C1 to a position C3) located in the space S surrounded by the positions A1, A2, A4 to A7 may be used to respectively adjust impedance matching of the second frequency band and the third frequency band.

It should be noted that in the embodiment, a length L1 of the antenna structure 100 is between 36 mm and 42 mm, which is, for example, 39 mm, and a width WW thereof is between 8 mm and 10 mm, which is, for example, 9 mm. Such small-sized antenna structure 100 may resonate the first frequency band, the second frequency band, and the third frequency band based on the design of the aforementioned first radiator 110 and the second radiator 120, so as to meet the requirement of multiple frequency bands under the premise of a small size.

Figure 2:
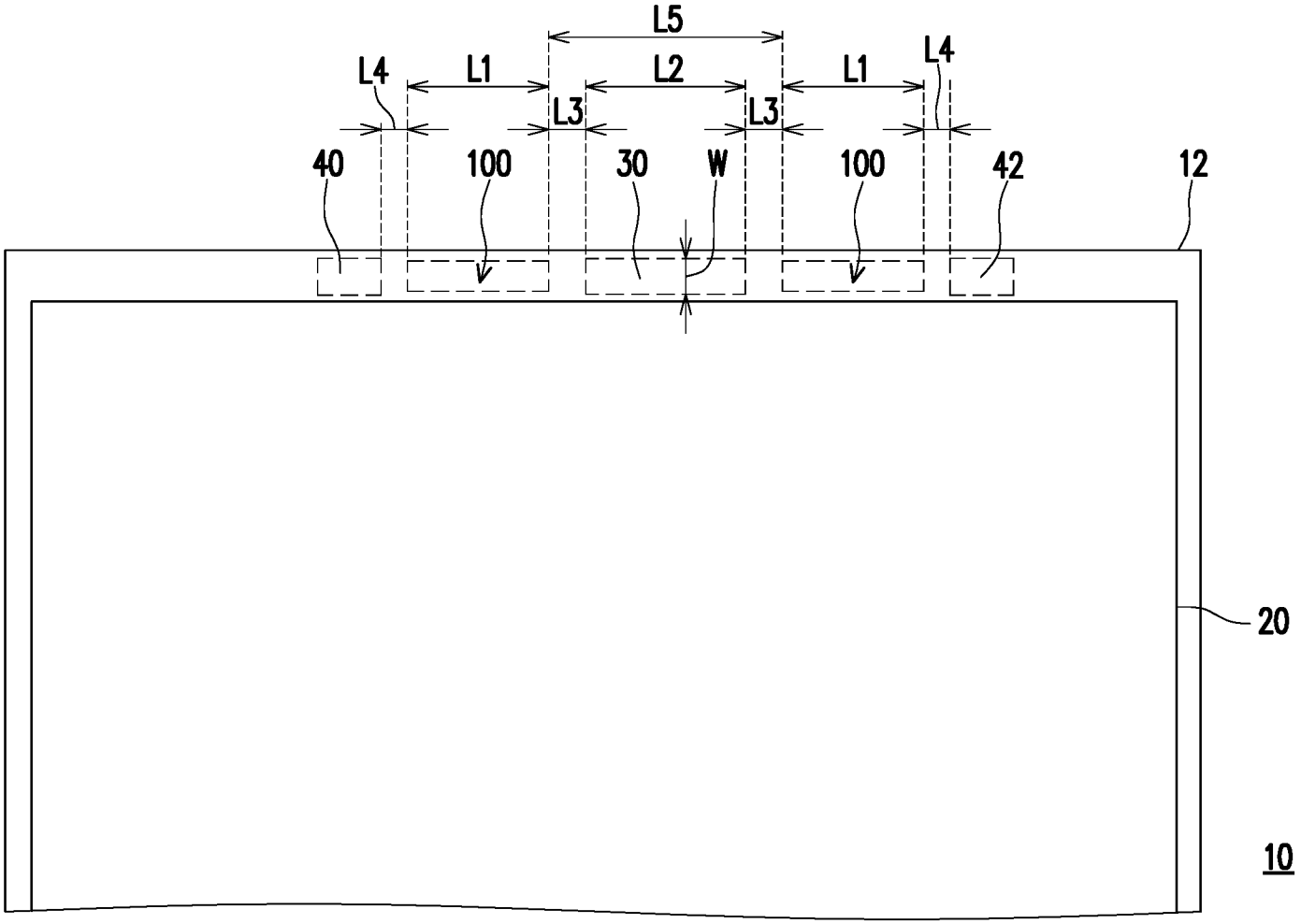
FIG. 2 is a partial schematic diagram of a communication device according to an embodiment of the application.

FIG. 2 is a partial schematic diagram of a communication device according to an embodiment of the application. Referring to FIG. 2, a communication device 10 of the embodiment is, for example, an upper body of a notebook computer, but in other embodiments, the communication device 10 may also be a tablet computer or other electronic devices, which is not limited by the application. The communication device 10 includes a casing 12 and a screen 20, two antenna structures 100 as shown in FIG. 1, an isolation element 30, and two conductors. The two antenna structures 100, the isolation element 30 and the two conductors are arranged in a gap between an edge of the casing 12 and the screen 20, i.e., arranged at a position of a border. In the embodiment, the two antenna structures 100 may be arranged in a symmetrical manner, and the two coaxial transmission lines 180 (shown in FIG. 1) may extend from the two antenna structures 100 to the left and right sides along the border to modules on a motherboard (not shown).

The two antenna structures 100 are spaced by a first distance L5. In the embodiment, the first distance L5 is between 60 mm and 70 mm, which is, for example, 65 mm. The isolation element 30 is disposed between the two antenna structures 100, and the isolation element 30 is, for example, a copper foil or an aluminium foil, but the application is not limited thereto. The isolation element 30 serves as a simulated metal wall to block a mutual influence between the two antenna structures 100 and improve an isolation between the two antenna structures 100. In addition, the isolation element 30 is a conductor with a length L2 between 40 mm and 50 mm, which is, for example, 45 mm. A width W of the isolation element 30 is between 8 mm and 10 mm, which is, for example, 9 mm.

The isolation element 30 is separated from each antenna structure 100 by a second distance L3. The second distance L3 is between 8 mm and 12 mm, which is, for example, 10 mm. In addition, conductors 40 and 42 are arranged at outer sides of the two antenna structures 100. A distance L4 between the antenna structure 100 and the conductors 40 and 42 is between 5 mm and 7 mm, which is, for example, 6 mm.

Based on the above dimensions, it is known that the two antenna structures 100 and the isolation element 30 do not need to occupy a large area, and may be applied to devices with a slim border. Certainly, the above dimensional relationship is not limited thereto.

Figure 3:
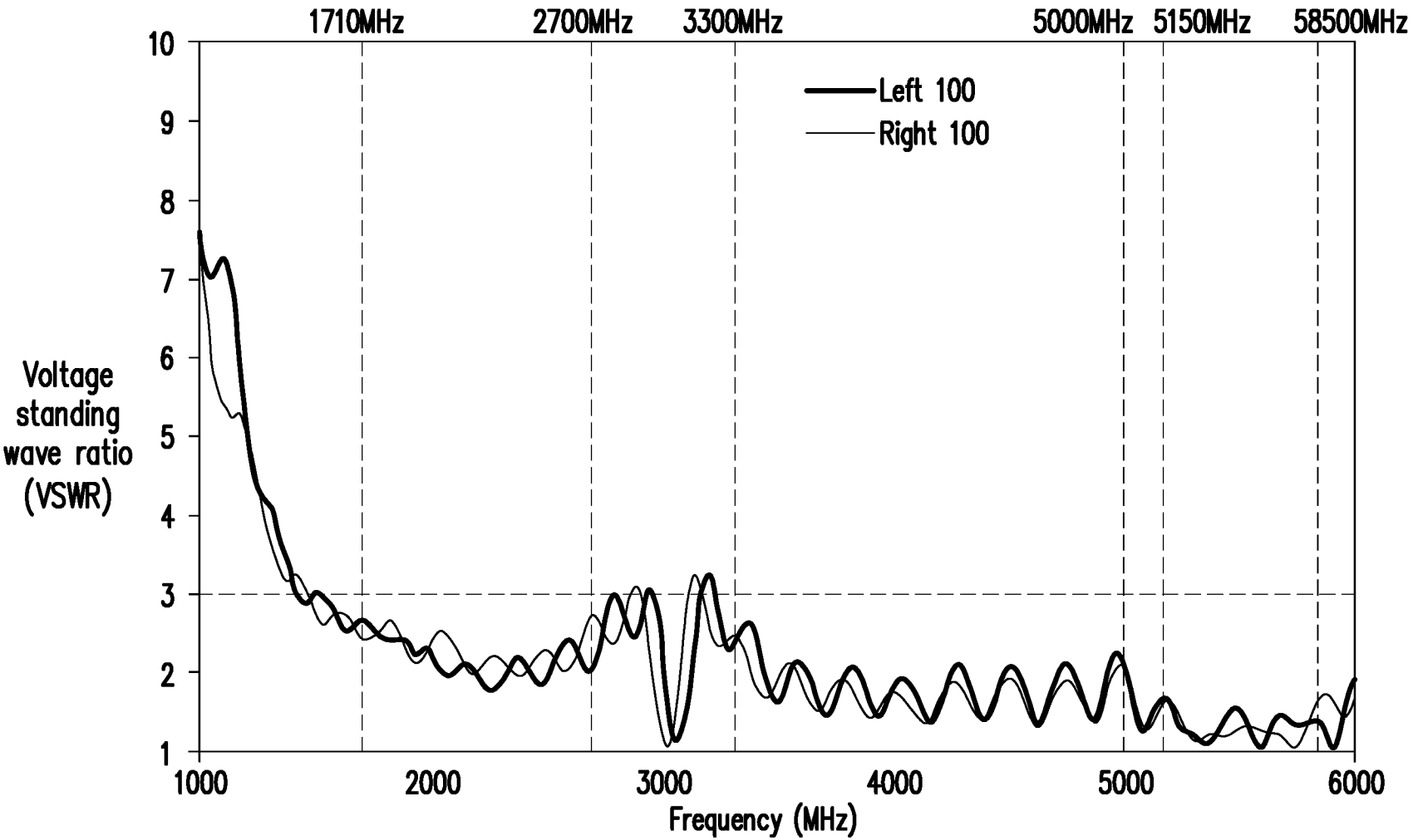
FIG. 3 is a schematic diagram of a frequency-voltage standing wave ratio relationship of two antenna structures of the communication device of FIG. 2.

FIG. 3 is a schematic diagram of a frequency-voltage standing wave ratio relationship of the two antenna structures of the communication device of FIG. 2. Referring to FIG. 3, voltage standing wave ratios (VSWR) of the two antenna structures 100 in the first frequency band (1710 MHz to 2700 MHz), the second frequency band (3300 MHz to 5000 MHz) and the third frequency band (5150 MHz to 5850 MHz) are all less than 3, so that the two antenna structures 100 have good performance.

Figure 4:
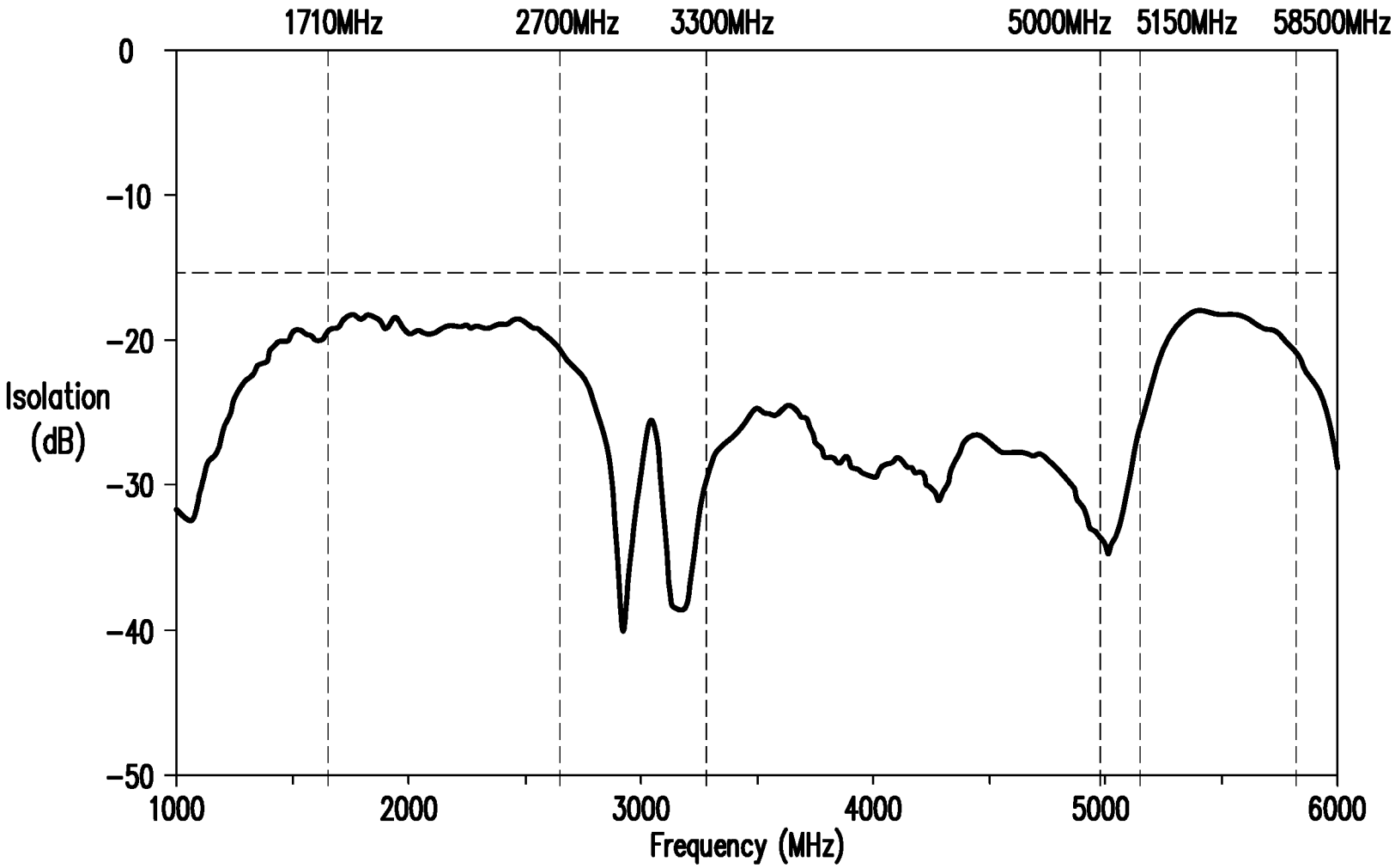
FIG. 4 is a schematic diagram of a frequency-isolation relationship of the two antenna structures of the communication device of FIG. 2.

FIG. 4 is a schematic diagram of a frequency-isolation relationship of the two antenna structures of the communication device of FIG. 2. Referring to FIG. 4, when the first distance L5 between the two antenna structures 100 is 65 mm, the second distance L3 between the isolation element 30 and each antenna structure 100 is 10 mm, and the distance L4 between each antenna structure 100 and the outer conductor is 6 mm, the isolation (i.e. S21) between the two antenna structures 100 in the first frequency band (1710 MHz to 2700 MHz), the second frequency band (3300 MHz to 5000 MHz) and the third frequency band (5150 MHz to 5850 MHz) may be below −15 dB, so that the two antenna structures 100 have good performance.

Figure 5:
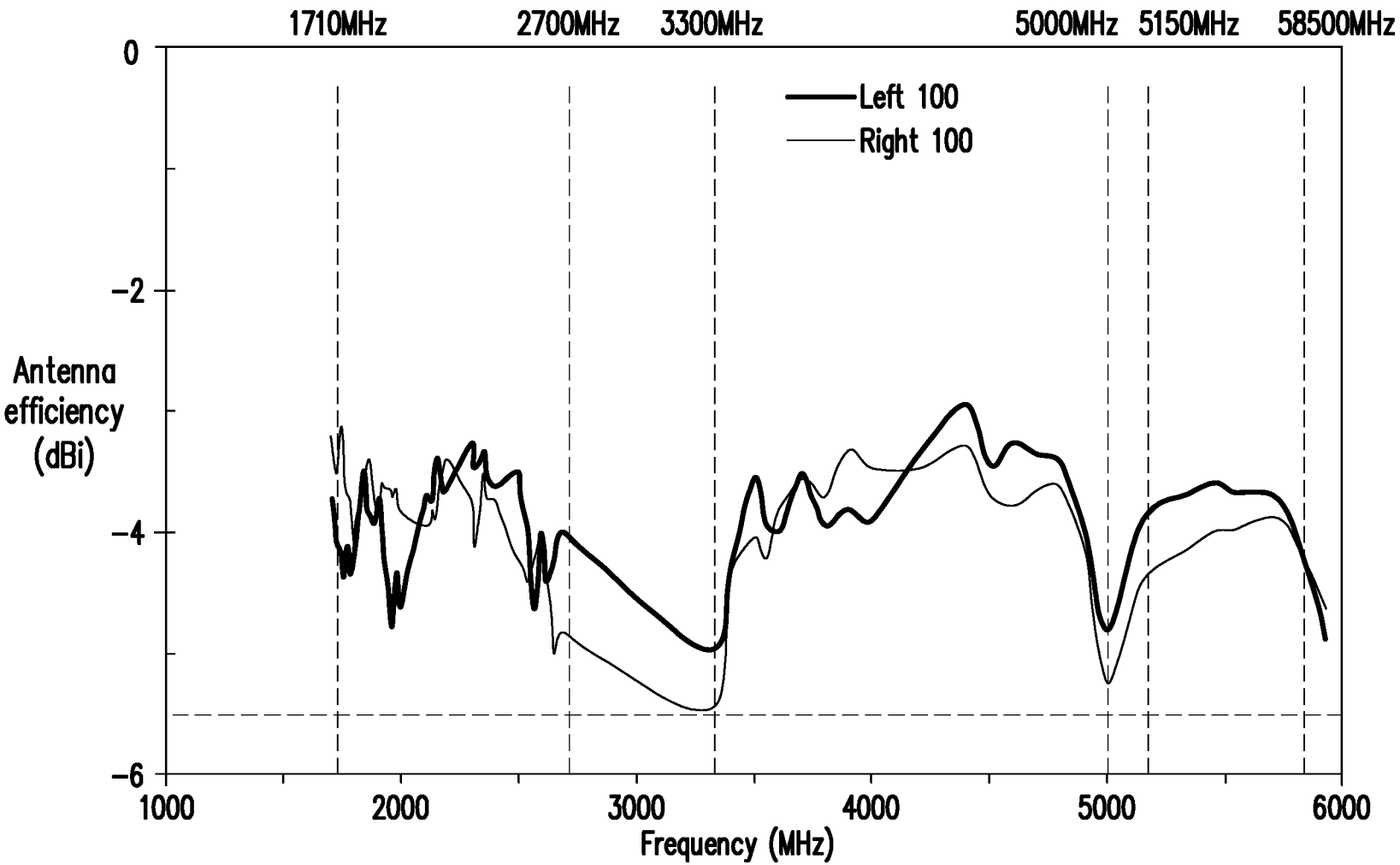
FIG. 5 is a schematic diagram of a frequency-antenna efficiency relationship of the two antenna structures of the communication device of FIG. 2.

FIG. 5 is a schematic diagram of a frequency-antenna efficiency relationship of the two antenna structures of the communication device of FIG. 2. Referring to FIG. 5, the two antenna structures 100 have antenna efficiency of −3.2 dBi to −5.0 dBi in the first frequency band (1710 MHz to 2700 MHz), and have antenna efficiency of −3.0 dBi to −5.5 dBi in the second frequency band (3300 MHz to 5000 MHz), and have antenna efficiency of −3.6 dBi to −5.2 dBi in the third frequency band (5150 MHz to 5850 MHz), and may achieve an efficiency performance of wideband antenna.

Figure 6:
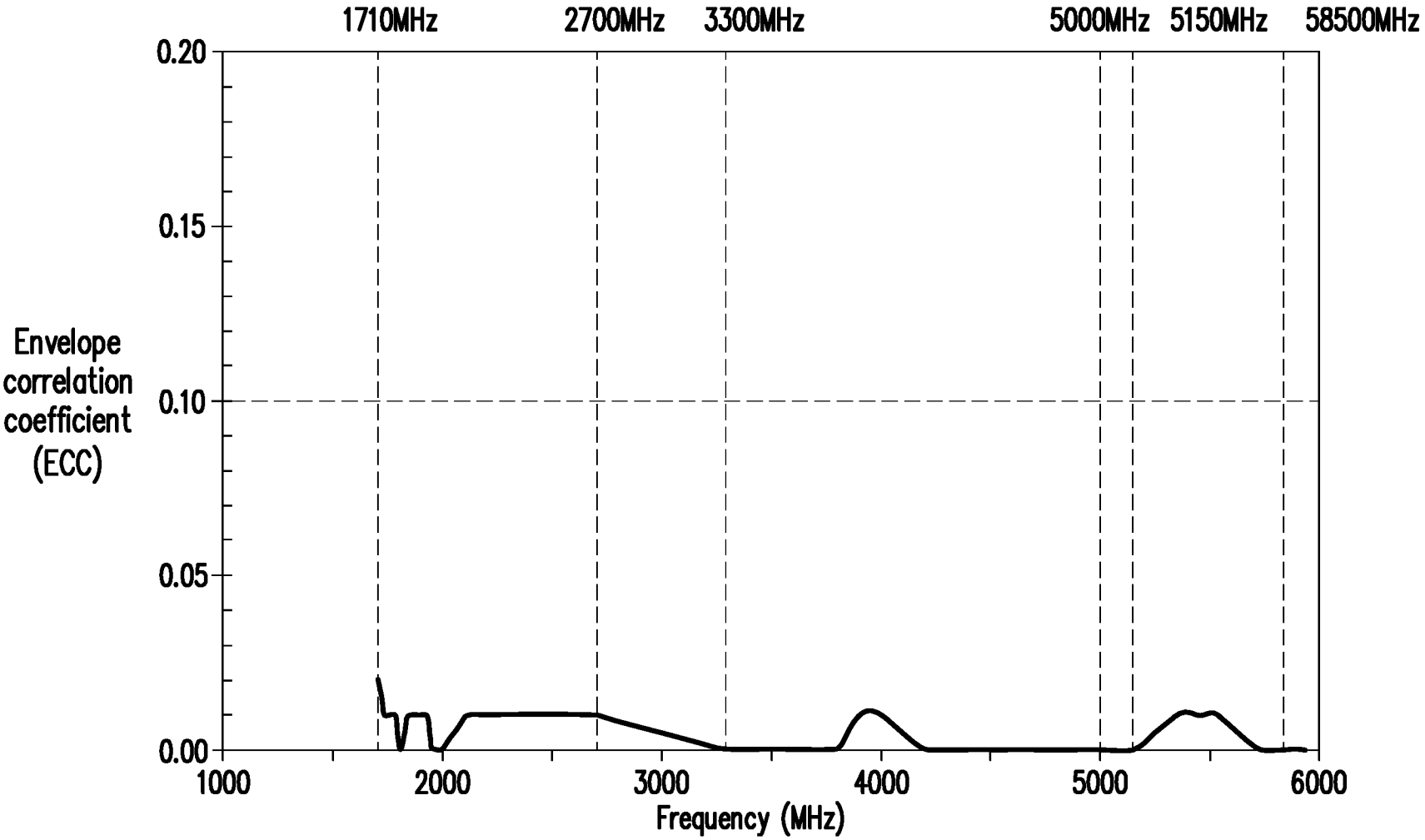
FIG. 6 is a schematic diagram of a frequency-envelope correlation coefficient relationship of the two antenna structures of the communication device of FIG. 2.

FIG. 6 is a schematic diagram of a frequency-envelope correlation coefficient relationship of the two antenna structures of the communication device of FIG. 2. Referring to FIG. 6, envelope correlation coefficients (ECCs) of the two antenna structures 100 in the first frequency band (1710 MHz to 2700 MHz), the second frequency band (3300 MHz to 5000 MHz) and the third frequency band (5150 MHz to 5850 MHz) may be below 0.1 or even below 0.02, so that the two antenna structures 100 have good performance.

Figure 7:
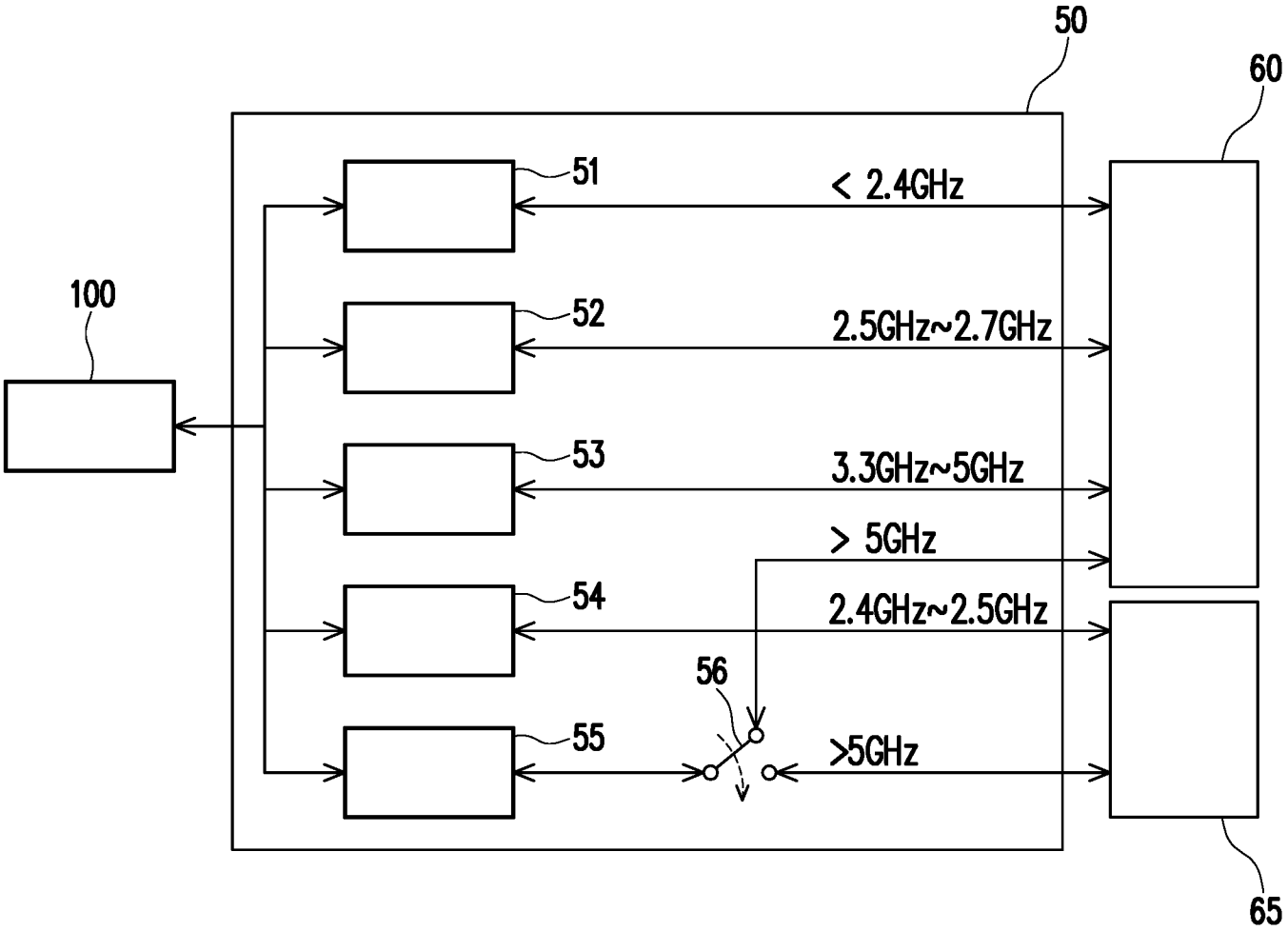
FIG. 7 is a partial schematic diagram of a communication device according to another embodiment of the application.

FIG. 7 is a partial schematic diagram of a communication device according to another embodiment of the application. Referring to FIG. 7, the communication device of the embodiment includes the antenna structure 100 of FIG. 1, an antenna-plexer 50, a first chip 60 and a second chip 65. The antenna-plexer 50 is connected to the antenna structure 100, and includes a first filter unit 51, a second filter unit 52, a third filter unit 53, a fourth filter unit 54, a fifth filter unit 55 and a switch unit 56.

Figure 8:
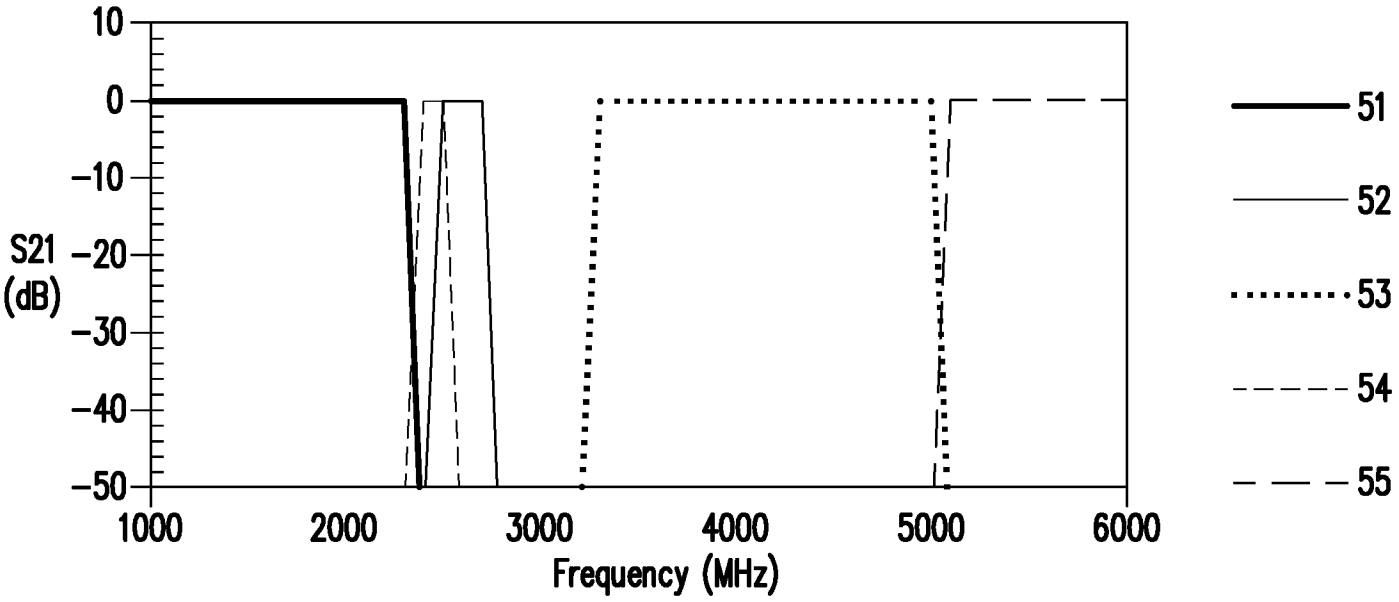
FIG. 8 is a schematic diagram of a frequency-S21 relationship of an antenna-plexer of the communication device of FIG. 7.

FIG. 8 is a schematic diagram of a frequency-S21 relationship of the antenna-plexer of the communication device of FIG. 7. Referring to FIG. 7 and FIG. 8, in the embodiment, the first filter unit 51 is a low-pass filter (LPF) unit, which allows signals with frequencies less than 2.4 GHz to pass through. The second filter unit 52 is a band-pass filter (BPF) unit, which allows signals with frequencies from 2.5 GHz to 2.7 GHz to pass through. The third filter unit 53 is a band-pass filter (BPF) unit, which allows signals with frequencies from 3.3 GHz to 5 GHz to pass through. The fourth filter unit 54 is a band-pass filter (BPF) unit, which allows signals with frequencies from 2.4 GHz to 2.5 GHz to pass through. The fifth filter unit 54 is a high-pass filter (HPF) unit, which allows signals with frequencies greater than 5 GHz to pass through. Certainly, the types and the filtering ranges of the first filter unit 51, the second filter unit 52, the third filter unit 53, the fourth filter unit 54 and the fifth filter unit 55 are not limited thereto.

Referring back to FIG. 7, the switch unit 56 is connected to the fifth filter unit 55. The first chip 60 is, for example, an LTE chip, the first chip 60 is connected to the first filter unit 51, the second filter unit 52, the third filter unit 53 and the switch unit 56. The second chip 65 is, for example, a WiFi chip, and the second chip 65 is connected to the fourth filter unit 54 and the switch unit 56. The switch unit 56 is switchably connected to the first chip 60 or the second chip 65 to selectively transmit a signal of the fifth filter unit 55 to the first chip 60 or the second chip 65.

In the embodiment, the antenna structure 100 is used in collaboration with the antenna-plexer 50, so that the antenna structure 100 can be selectively used as an LTE antenna or a WiFi antenna, which may achieve functions of two antennas within a limited space, and achieve an application of MIMO multiple antennas.

In summary, the antenna structure of the application is capable of resonating the first frequency band, the second frequency band and the third frequency band based on a design of the first radiator and the second radiator, so as to meet a requirement of multiple frequency bands. In an embodiment, two antenna structures may be spaced by the first distance, and the isolation unit is arranged between the two antenna structures, so that the two antenna structures have good isolation. In an embodiment, the antenna structure of the communication device is switchably connected to the first chip or the second chip through the switch unit of the antenna-plexer, which uses a single antenna to achieve an effect of multiple antennas, and achieves a target of sharing an antenna space and reducing a usage amount of antenna.

What is claimed is:

1. An antenna structure, comprising:

a first radiator, comprising a first section, a second section, and a third section, wherein the first section comprises a feed-in end, the second section is adjacent to the first section and is connected to a position of the first section close to the feed-in end, and the third section is connected to the second section and the feed-in end to encircle a space; and a second radiator, disposed around the first section and the second section, and comprising a first end and a second end opposite to each other, wherein the first end is a ground end, a coupling interval is formed between the second end and the third section, and a first frequency band, a second frequency band, and a third frequency band are resonated by the first radiator and the second radiator.

2. The antenna structure as claimed in claim 1, further comprising:

a first frequency modulation radiator, located in the space and connected to the feed-in end; and a second frequency modulation radiator, located in the space and connected to the feed-in end, and the second frequency modulation radiator surrounding the first frequency modulation radiator.

3. The antenna structure as claimed in claim 2, wherein an interval between the first frequency modulation radiator and the second frequency modulation radiator is between 0.3 mm and 0.5 mm.

4. The antenna structure as claimed in claim 1, wherein the third section has a first region, a second region, and a third region connected in a bending manner, the first region is connected to the second section, the third region is connected to the feed-in end, and a slot is formed in the third region.

5. The antenna structure as claimed in claim 1, further comprising an antenna ground plane, wherein the second radiator comprises a fourth section, a fifth section, and a sixth section, the fifth section is respectively connected to the fourth section and the sixth section, the first end is located at the fourth section, the second end is located at the sixth section, and the fourth section is connected to the antenna ground plane.

6. The antenna structure as claimed in claim 1, wherein the coupling interval is between 0.5 mm and 1 mm.

7. The antenna structure as claimed in claim 1, wherein a length of the antenna structure is between 36 mm and 42 mm, and a width of the antenna structure is between 8 mm and 10 mm.

8. The antenna structure as claimed in claim 1, wherein the first frequency band is between 1710 MHz and 2700 MHz, the second frequency band is between 3300 MHz and 5000 MHz, and the third frequency band is between 5150 MHz and 5850 MHz.

9. A communication device, comprising:

an antenna structure, comprising:

a first radiator, comprising a first section, a second section, and a third section, wherein the first section comprises a feed-in end, the second section is adjacent to the first section and is connected to a position of the first section close to the feed-in end, and the third section is connected to the second section and the feed-in end to encircle a space; and a second radiator, disposed around the first section and the second section, and comprising a first end and a second end opposite to each other, wherein the first end is a ground end, a coupling interval is formed between the second end and the third section, and a first frequency band, a second frequency band, and a third frequency band are resonated by the first radiator and the second radiator;

an antenna-plexer, connected to the antenna structure and comprising a first filter unit, a second filter unit, a third filter unit, a fourth filter unit, a fifth filter unit, and a switch unit, wherein the switch unit is connected to the fifth filter unit;

a first chip, connected to the first filter unit, the second filter unit, the third filter unit, and the switch unit; and a second chip, connected to the fourth filter unit and the switch unit, wherein the switch unit is switchably connected to the first chip or the second chip.

10. The communication device as claimed in claim 9, further comprising:

a first frequency modulation radiator, located in the space and connected to the feed-in end; and a second frequency modulation radiator, located in the space and connected to the feed-in end, and the second frequency modulation radiator surrounding the first frequency modulation radiator.

11. The communication device as claimed in claim 9, wherein the third section has a first region, a second region, and a third region connected in a bending manner, the first region is connected to the second section, the third region is connected to the feed-in end, and a slot is formed in the third region.

12. The communication device as claimed in claim 9, further comprising an antenna ground plane, wherein the second radiator comprises a fourth section, a fifth section, and a sixth section, the fifth section is respectively connected to the fourth section and the sixth section, the first end is located at the fourth section, the second end is located at the sixth section, and the fourth section is connected to the antenna ground plane.

13. The communication device as claimed in claim 9, wherein the first frequency band is between 1710 MHz and 2700 MHz, the second frequency band is between 3300 MHz and 5000 MHz, and the third frequency band is between 5150 MHz and 5850 MHz.

14. A communication device, comprising:

two antenna structures, wherein the two antenna structures are spaced by a first distance, and each of the two antenna structures comprises:

a first radiator, comprising a first section, a second section, and a third section, wherein the first section comprises a feed-in end, the second section is adjacent to the first section and is connected to a position of the first section close to the feed-in end, and the third section is connected to the second section and the feed-in end to encircle a space; and a second radiator, disposed around the first section and the second section, and comprising a first end and a second end opposite to each other, wherein the first end is a ground end, a coupling interval is formed between the second end and the third section, and a first frequency band, a second frequency band, and a third frequency band are resonated by the first radiator and the second radiator; and an isolation element, disposed between the two antenna structures and spaced from each of the antenna structures by a second distance.

15. The communication device as claimed in claim 14, further comprising:

a first frequency modulation radiator, located in the space and connected to the feed-in end; and a second frequency modulation radiator, located in the space and connected to the feed-in end, and the second frequency modulation radiator surrounding the first frequency modulation radiator.

16. The communication device as claimed in claim 14, wherein the third section has a first region, a second region, and a third region connected in a bending manner, the first region is connected to the second section, the third region is connected to the feed-in end, and a slot is formed in the third region.

17. The communication device as claimed in claim 14, further comprising an antenna ground plane, wherein the second radiator comprises a fourth section, a fifth section, and a sixth section, the fifth section is respectively connected to the fourth section and the sixth section, the first end is located at the fourth section, the second end is located at the sixth section, and the fourth section is connected to the antenna ground plane.

18. The communication device as claimed in claim 14, wherein the first frequency band is between 1710 MHz and 2700 MHz, the second frequency band is between 3300 MHz and 5000 MHz, and the third frequency band is between 5150 MHz and 5850 MHz.

19. The communication device as claimed in claim 14, wherein the first distance is between 60 mm and 70 mm, and the second distance is between 8 mm and 12 mm.

20. The communication device as claimed in claim 14, wherein the isolation element is a conductor with a length between 40 mm and 50 mm.

* * * * *